US010337775B2

(12) United States Patent
Misaljevic

(10) Patent No.: US 10,337,775 B2
(45) Date of Patent: Jul. 2, 2019

(54) METHOD AND APPARATUS FOR NOISE ATTENUATION FOR HVAC AND R SYSTEM

(71) Applicant: JOHNSON CONTROLS TECHNOLOGY COMPANY, Holland, MI (US)

(72) Inventor: Sasa Misaljevic, Toronto (CA)

(73) Assignee: Johnson Controls Technology Company, Auburn Hills, MI (US)

( * ) Notice: Subject to any disclaimer, the term of this patent is extended or adjusted under 35 U.S.C. 154(b) by 148 days.

(21) Appl. No.: 14/582,292

(22) Filed: Dec. 24, 2014

(65) Prior Publication Data

US 2015/0252868 A1 Sep. 10, 2015

Related U.S. Application Data

(60) Provisional application No. 61/947,588, filed on Mar. 4, 2014.

(51) Int. Cl.

| | |
|---|---|
| ***F24F 13/32*** | (2006.01) |
| ***F24F 13/24*** | (2006.01) |
| ***F25B 39/02*** | (2006.01) |

(52) U.S. Cl.

CPC ..... *F25B 39/02* (2013.01); *F24F 13/24* (2013.01); *F24F 13/32* (2013.01); *F25B 2500/13* (2013.01)

(58) Field of Classification Search

CPC ..... F25B 2500/13; F24F 1/022; F24F 1/027; F24F 13/24; F24F 13/32; F24F 2013/245

See application file for complete search history.

(56) References Cited

U.S. PATENT DOCUMENTS 1,880,280 A * 10/1932 Replogle ..... F25D 23/006 200/82 R
2,257,374 A * 9/1941 Fritz ..... F25D 19/00 312/138.1

(Continued)

FOREIGN PATENT DOCUMENTS

CA 1240963 A 8/1988
CA 2030075 4/1994

(Continued)

OTHER PUBLICATIONS

Canadian Office Action for CA Application No. 2,845,520 dated Sep. 27, 2017, 4 pgs.

(Continued)

*Primary Examiner* — Christopher R Zerphey
(74) *Attorney, Agent, or Firm* — Fletcher Yoder, P.C.

(57) ABSTRACT

An apparatus for noise attenuation of an HVAC&R system including an enclosure having a first enclosure frame and a chassis insertable inside the enclosure and supported by the first enclosure frame upon insertion inside the enclosure. The chassis includes a first chassis structure securing a self-contained refrigerant loop. The loop maintains a gap from the enclosure upon insertion of the chassis inside the enclosure. A second chassis structure supports the first chassis structure. At least one vibration damping device is positioned beneath the first chassis structure and between the first chassis structure and the second chassis structure. The vibration damping device is supported by the second chassis structure, the second chassis structure is supported by the first enclosure frame. The enclosure is vibrationally isolated from the loop.

12 Claims, 11 Drawing Sheets

(56) References Cited

U.S. PATENT DOCUMENTS

| | | | | |
|---|---|---|---|---|
| 4,352,635 | A | 10/1982 | Saunders | |
| 4,462,460 | A * | 7/1984 | Braver | F24F 1/0033 165/207 |
| 4,887,399 | A * | 12/1989 | Berger | F24F 13/32 248/678 |
| 4,976,114 | A * | 12/1990 | Manning | F16F 3/087 165/48.1 |
| 5,309,892 | A | 5/1994 | Lawlor | |
| 5,396,782 | A | 3/1995 | Ley et al. | |
| 6,260,373 | B1 * | 7/2001 | Rockwood | F16F 7/1028 165/69 |
| 6,260,374 | B1 | 7/2001 | Smith et al. | |
| 7,458,556 | B1 | 12/2008 | Manucy | |
| 8,616,517 | B2 | 12/2013 | Huth et al. | |
| 8,616,860 | B2 | 12/2013 | Wollitz | |
| 8,622,376 | B2 | 1/2014 | Lavigne | |
| 8,714,943 | B2 | 5/2014 | Bahmata et al. | |
| 8,777,193 | B2 | 7/2014 | Loret De Mola | |
| 8,870,550 | B2 | 10/2014 | Tozawa et al. | |
| 8,876,092 | B2 | 11/2014 | Wojcieson | |
| 8,911,003 | B2 | 12/2014 | Selent et al. | |
| 8,978,849 | B2 | 3/2015 | Minola | |
| 2004/0168464 | A1 * | 9/2004 | Seo | F16F 1/3732 62/295 |
| 2011/0064571 | A1 * | 3/2011 | Lind | F04D 29/4213 415/206 |
| 2011/0232860 | A1 | 9/2011 | Lackie et al. | |
| 2012/0193505 | A1 * | 8/2012 | Baron | F24F 1/40 248/636 |
| 2014/0001686 | A1 | 1/2014 | Jung | |
| 2014/0050572 | A1 | 2/2014 | Mehta et al. | |
| 2014/0115868 | A1 | 5/2014 | Ruhlander | |
| 2014/0157814 | A1 | 6/2014 | Duplessis et al. | |
| 2014/0202199 | A1 | 7/2014 | Hirai et al. | |
| 2015/0039139 | A1 | 2/2015 | Meeuwsen | |
| 2015/0122969 | A1 | 5/2015 | Sugita et al. | |

FOREIGN PATENT DOCUMENTS

| | | | |
|---|---|---|---|
| CA | 2733678 | | 9/2011 |
| EP | 1018627 | B1 | 7/2006 |
| EP | 1913283 | B1 | 4/2008 |
| JP | 09203533 | A | 8/1997 |
| JP | 2010151260 | A | 7/2010 |
| JP | 2012012984 | A | 1/2012 |
| JP | 2012184702 | A | 9/2012 |
| JP | 2014055633 | A | 3/2014 |
| JP | 2014105853 | A | 6/2014 |
| JP | 2014178022 | A | 9/2014 |
| JP | 2014185555 | A | 10/2014 |
| WO | 2014011870 | A1 | 1/2014 |
| WO | 2014016143 | A2 | 1/2014 |
| WO | 2014051017 | A1 | 4/2014 |
| WO | 2015013793 | A1 | 2/2015 |
| WO | 2015013794 | A1 | 2/2015 |

OTHER PUBLICATIONS

Canadian Office Action for CA Application No. 2,845,520 dated Apr. 8, 2016, 5 pgs.

* cited by examiner

METHOD AND APPARATUS FOR NOISE ATTENUATION FOR HVAC AND R SYSTEM

BACKGROUND

The application relates generally to HVAC&R systems. The application relates more specifically to noise attenuation for HVAC&R systems.

Heating and cooling systems typically maintain temperature control in a structure by circulating a fluid within coiled tubes such that passing another fluid over the tubes effects a transfer of thermal energy between the two fluids. A primary component in such a system is a compressor which receives a cool, low pressure gas and by virtue of a compression device, exhausts a hot, high pressure gas. The compressor is typically secured within an enclosure that directs fluid flow to the structure for maintaining temperature control. During operation of the compressor, vibrations are generated that can propagate through the enclosure, resulting in noise generation in audible frequency bands, which is undesirable.

In response, attempts have been made to isolate the compressor vibration with limited success, as not only does the compressor vibrate, but also components that are operatively connected to the compressor, such as fluid lines.

Accordingly, there is an unmet need for reliably and inexpensively isolating compressor vibration for providing noise attenuation for HVAC&R systems.

SUMMARY

One embodiment of the present disclosure is directed to an apparatus for noise attenuation of an HVAC&R system including an enclosure having a first enclosure frame. A chassis is insertable inside the enclosure and supported by the first enclosure frame upon insertion of the chassis inside the enclosure. The chassis includes a first chassis structure, and a self-contained refrigerant loop secured to the first chassis structure, the loop maintaining a gap from the enclosure upon insertion of the chassis inside the enclosure. The loop includes a compressor, a first heat exchanger, and a second heat exchanger. A second chassis structure supports the first chassis structure; and at least one vibration damping device is positioned beneath the first chassis structure and between the first chassis structure and the second chassis structure. The vibration damping device is supported by the second chassis structure, the second chassis structure supported by the first enclosure frame. The enclosure is vibrationally isolated from the refrigerant loop.

Another embodiment of the present disclosure is directed to a method for noise attenuation of an HVAC&R system having a compressor including a closed refrigerant loop comprising a first heat exchanger and a second heat exchanger for selectively providing climate control for a structure. The method includes providing a chassis for securing at least each of the compressor, the first heat exchanger and the second heat exchanger of the loop in an enclosure, the loop being self-contained and maintained in non-contact with the enclosure when the chassis is positioned in the enclosure. The method further includes operating the system.

Yet another embodiment of the present disclosure is directed to an HVAC&R system including an enclosure having a first enclosure frame. A chassis is insertable inside the enclosure and supported by the first enclosure frame upon insertion of the chassis inside the enclosure. The chassis includes a first chassis structure and a self-contained refrigerant loop secured to the first chassis structure. The loop maintains a gap from the enclosure upon insertion of the chassis inside the enclosure, the loop including a compressor, a first heat exchanger, and a second heat exchanger. A second chassis structure supports the first chassis structure. At least one vibration damping device is positioned beneath the first chassis structure and between the first chassis structure and the second chassis structure. The vibration damping device is supported by the second chassis structure, and the second chassis structure supported by the first enclosure frame. The enclosure is vibrationally isolated from the refrigerant loop.

DETAILED DESCRIPTION OF EXEMPLARY EMBODIMENTS

Figure 1:
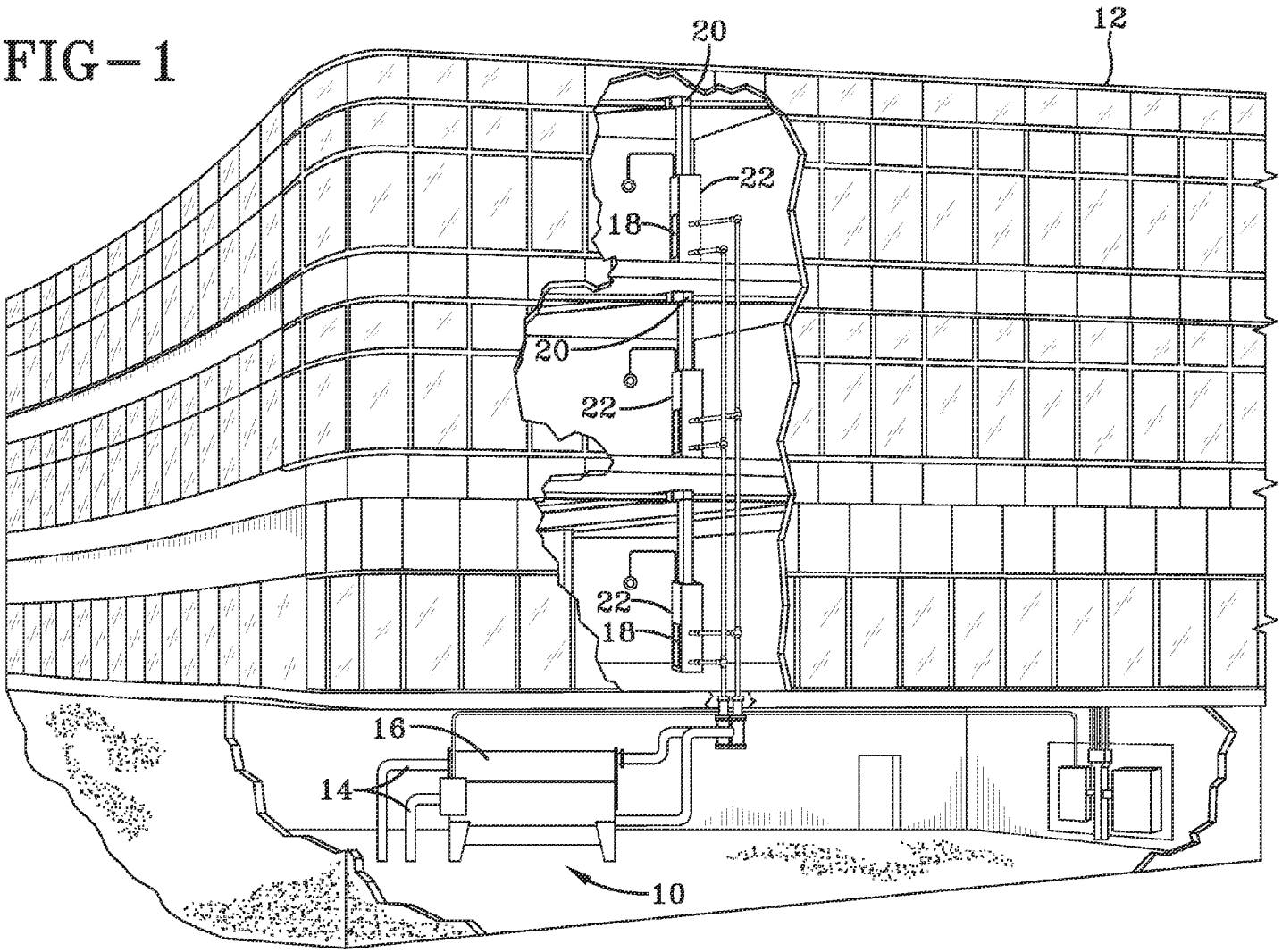
FIG. 1 shows an exemplary embodiment for a heating, ventilation and air conditioning (HVAC&R) system.

FIG. 1 shows an exemplary environment for an HVAC&R system 10 in a building 12 for a typical commercial setting, such as a hotel containing a plurality of building compartment such as rooms for rent. System 10 may include a compressor (not shown in FIG. 1) incorporated into a chiller 16 that receives a fluid, such as water via a conduit 14 from a fluid source (not shown in FIG. 1) stored in the ground, or a fluid circulated through closed pipe loops buried in the ground. A boiler (shown schematically in FIG. 2 as boiler 40) is also arranged to receive, such as via conduit 14, fluid from the fluid source. A purpose of chiller 16 and the boiler is to provide fluid, such as water, at a predetermined temperature that is greater than the dew point temperature of the fluid to a plurality of heat pumps 22 for individually maintaining temperature control in the building compartments, while minimizing the formation of condensation in the heat pumps 22. Operation of a conventional chiller (e.g., chiller 16) is discussed in further detail, such as in Applicant's patent application Ser. No. 14/055,429, filed Oct. 16, 2013, entitled "Screw Compressor", which is hereby incorporated by reference. System 10 includes an air distribution system that circulates air through building 12. As further shown in FIG. 1, the air distribution system can include an air return duct 18 and an air supply duct 20 for maintaining temperature control in the building compartments. In one embodiment, one or more heat pumps 22 may be utilized for maintaining temperature control in larger, open areas of building 12 (i.e., areas larger than hotel rooms for rent).

Figure 2:
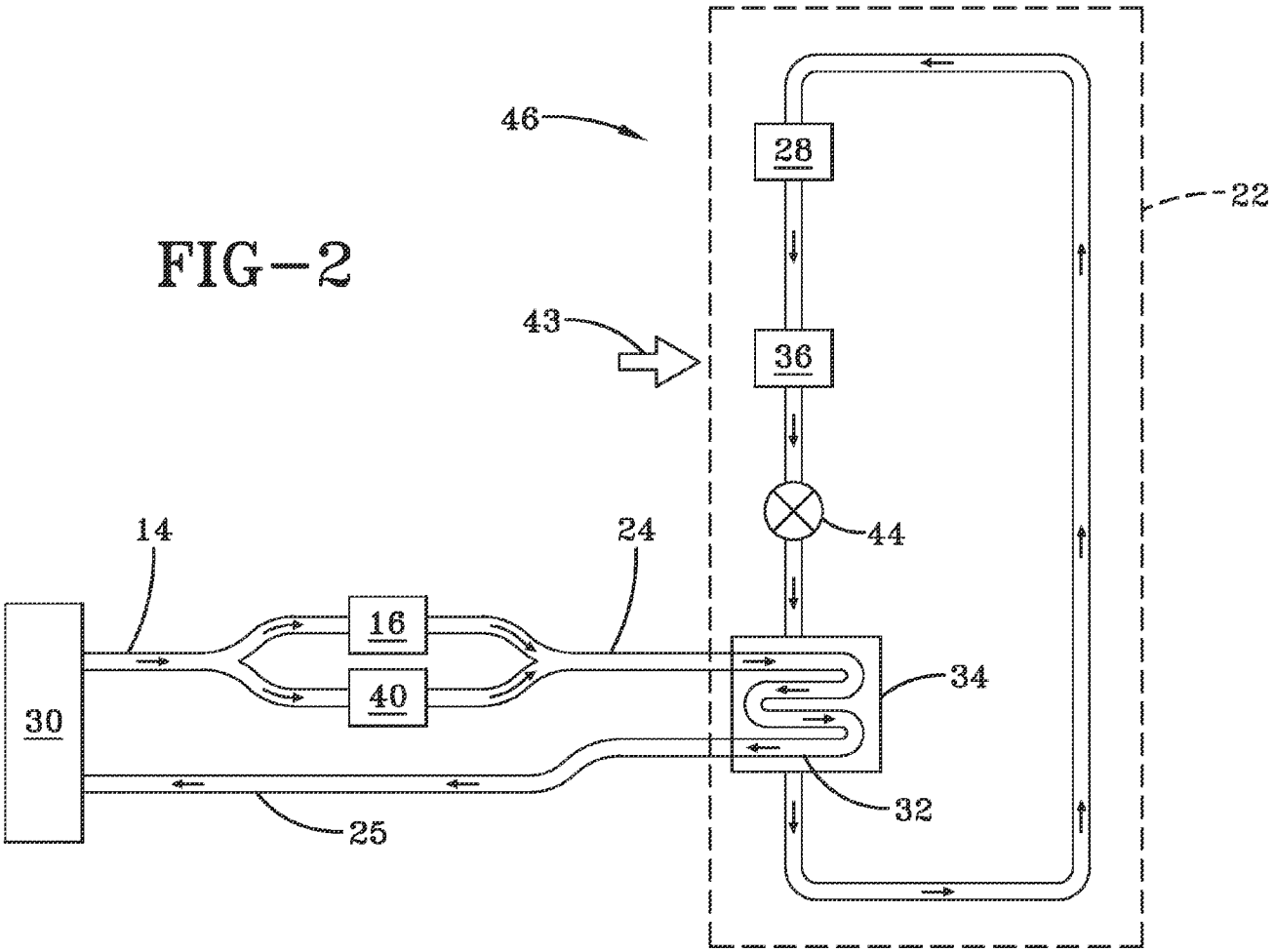
FIG. 2 schematically illustrates an exemplary embodiment of an HVAC&R system operating in a cooling mode.

FIG. 2 shows an exemplary HVAC&R system 10 in a heating mode 46. System 10 includes both chiller 16 and boiler 40 in fluid communication with a conduit 14 for providing a fluid, such as water from a fluid source 30 stored above or in the ground, or a fluid circulated through closed pipe loops buried in the ground. In one embodiment, the fluid is cooled and/or heated by chiller 16 and boiler 40, respectively, providing fluid at a temperature greater than its dew point to minimize the formation of condensation during operation of heat pump 22, also referred to as conditioned fluid. While not shown in FIG. 2 (or FIG. 3), it is to be understood that other heat pumps 22, as shown in FIG. 1, are also operatively connected with chiller 16 and boiler 40 as part of system 10. Upon being discharged from chiller 16 and/or boiler 40, conditioned fluid is provided via conduits 24 to a heat exchanger coil 32 of a heat exchanger 34 of heat pump 22 utilized in a heating mode 46. After the conditioned fluid has passed in a heat exchange relationship with heat exchanger coil 32, the fluid returns via conduit 25 to fluid source 30.

As shown in FIG. 2, in heating mode 46, heat pump 22 comprises a self-contained refrigerant loop, comprising a compressor 28, a heat exchanger 36 (operating as a condenser in heating mode 46), and an expansion valve 44 interposed between heat exchanger 34 (operating as an evaporator in heating mode 46) and heat exchanger 36 (condenser). Refrigerant vapor received by compressor 28 from heat exchanger 34 (evaporator) is compressed, becoming heated, pressurized refrigerant vapor. Refrigerant vapor delivered to heat exchanger 36 (condenser) enters into a heat exchange relationship with return air 43 that is urged by a fan 42 to flow inside of an enclosure 50 (FIG. 5), and undergoes at least a partial phase change to a mixture of a refrigerant liquid and a refrigerant vapor as a result of the heat exchange relationship with the return air 43. The condensed liquid refrigerant from heat exchanger 36 (condenser) flows through an expansion valve 44 and into a heat exchange relationship with a heat exchanger coil 32 of heat exchanger 34 (operating as an evaporator in heating mode 46). Heat exchanger coil 32 provides conditioned fluid from fluid source 30 that results in liquid refrigerant undergoing a phase change to refrigerant vapor that is delivered to compressor 28 in a repeating cycle.

Figure 3:
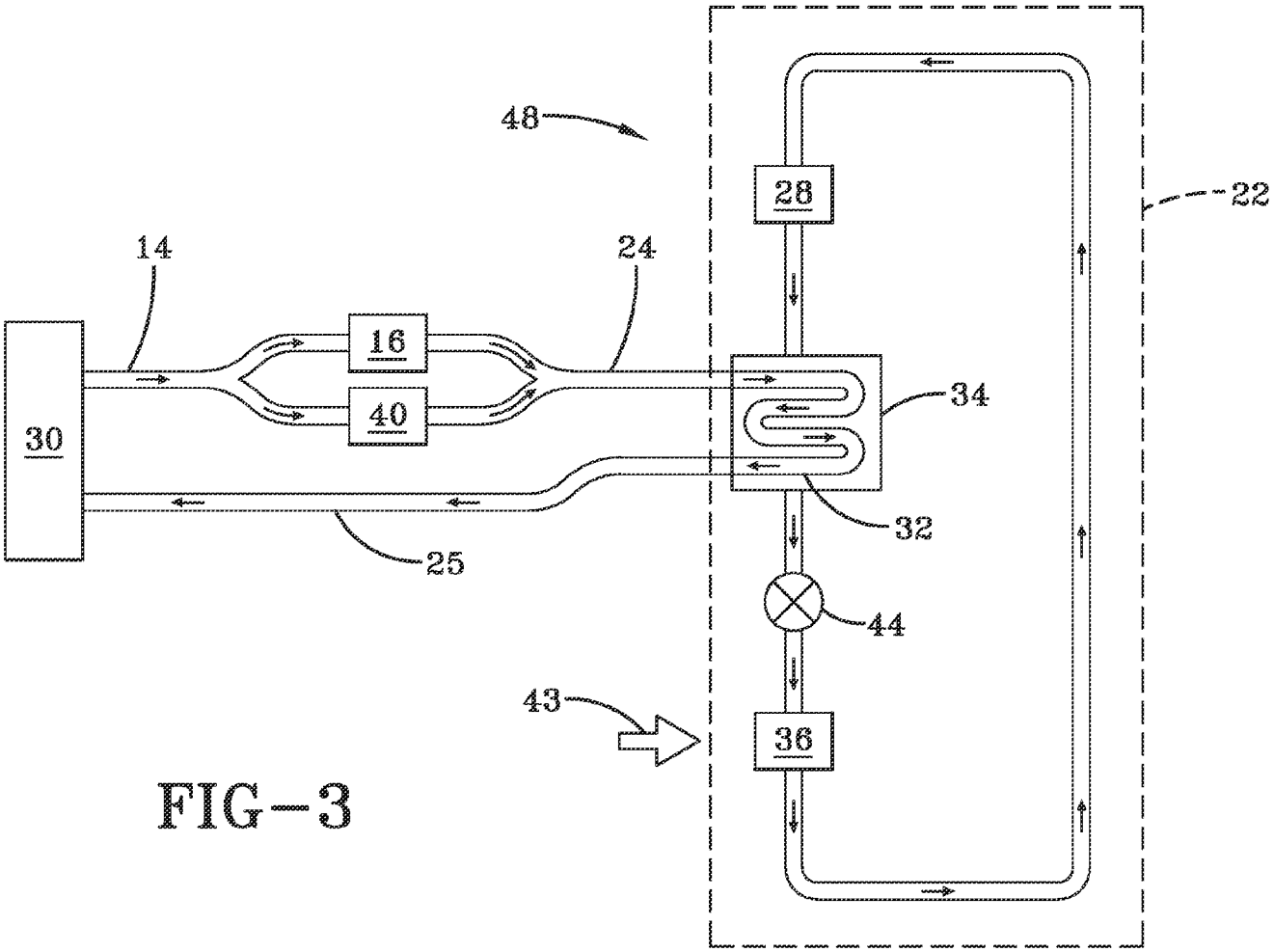
FIG. 3 schematically illustrates an exemplary embodiment of an HVAC&R system operating in a heating mode.

As shown in FIG. 3, in cooling mode 48, heat pump 22 comprises a self-contained refrigerant loop, comprising compressor 28, heat exchanger 34 (operating as a condenser in cooling mode 48), and an expansion valve 44 interposed between heat exchanger 36 (operating as an evaporator in cooling mode 48) and heat exchanger 34 (condenser). The self-contained refrigerant loop components are interconnected to each other, forming the loop. Heat pump 22 utilizes a reversing valve (not shown) of known construction to reverse the flow of refrigerant through the refrigerant loop between heating mode 46 and cooling mode 48. Refrigerant vapor received by compressor 28 from heat exchanger 36 (evaporator) is compressed, becoming heated, pressurized refrigerant vapor. Refrigerant vapor delivered to heat exchanger 34 (condenser) enters into a heat exchange relationship with heat exchanger coil 32 of heat exchanger 34 (operating as a condenser in cooling mode 48). Heat exchanger coil 32 provides conditioned fluid from fluid source 30 that results in refrigerant vapor undergoing at least a partial phase change to a mixture of a refrigerant liquid and a refrigerant vapor as a result of the heat exchange relationship with heat exchanger coil 32. The condensed liquid refrigerant from heat exchanger 34 (condenser) flows through expansion valve 44 and into a heat exchange relationship with return air 43 that is urged by fan 42 to flow inside of enclosure 50 (FIG. 5), resulting in liquid refrigerant undergoing a phase change to refrigerant vapor that is delivered to compressor 28 in a repeating cycle.

Figure 5:
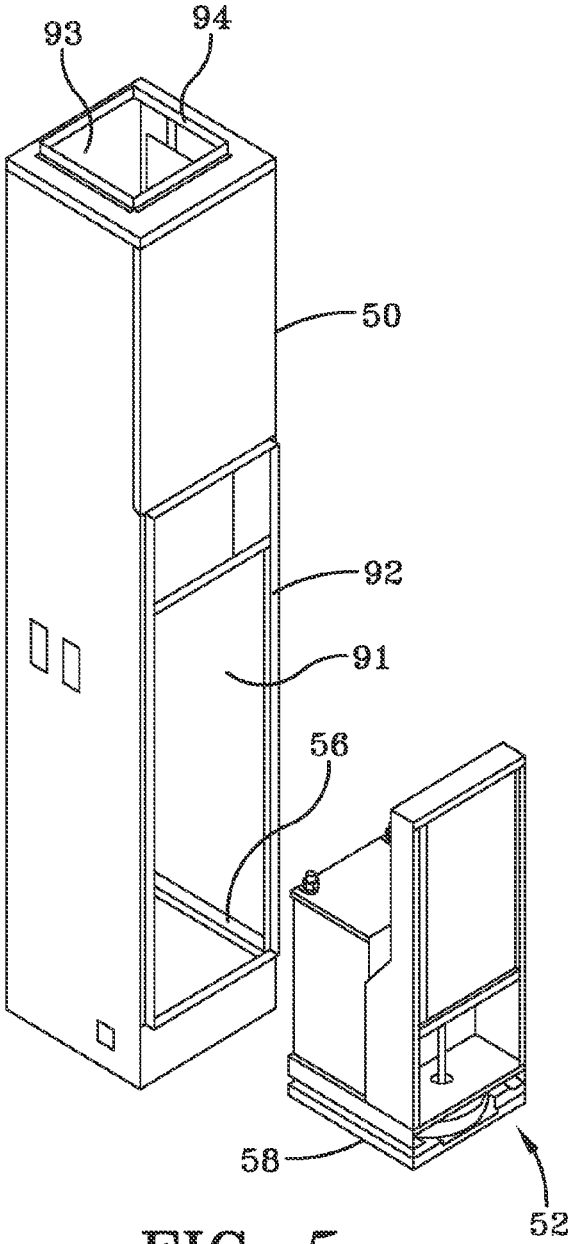
FIG. 5 shows an upper perspective view of an exemplary embodiment of the heat pump of FIG. 4 prior to insertion of an exemplary chassis.

As used herein, the term self-contained means that at least the identified refrigerant loop components are secured to a selectively installable/removable structure, such as a chassis 52 (FIG. 5). As used herein, the term chassis is intended to interchangeably include the support structure for supporting refrigerant loop components, as well as the combination of support structure and refrigerant loop components.

Figure 4:
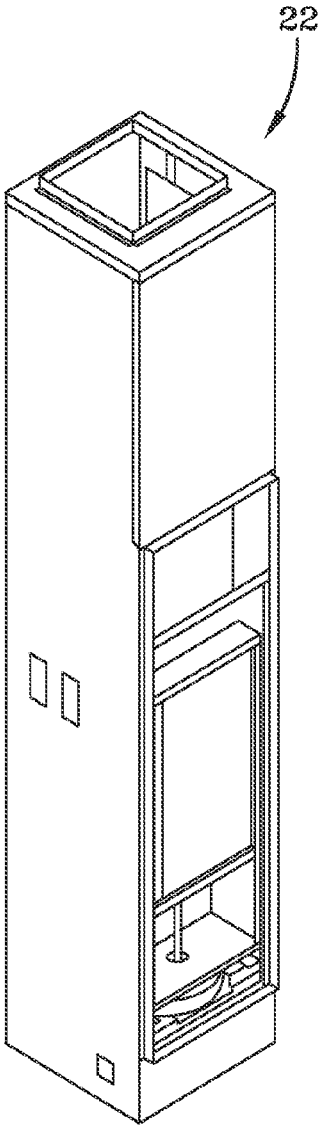
FIG. 4 shows an upper perspective view of an exemplary embodiment of a heat pump.
Figure 6:
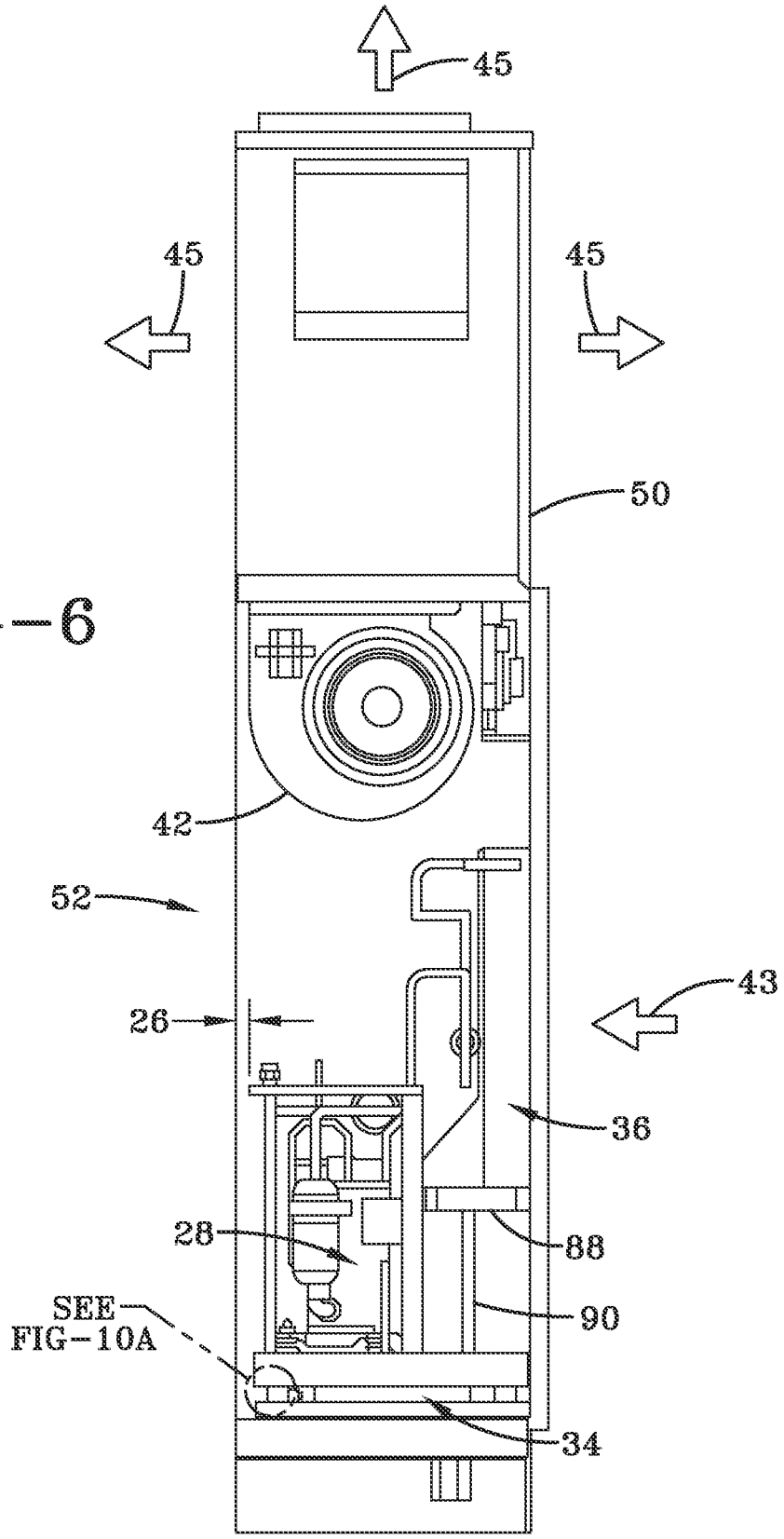
FIG. 6 shows a partial cutaway view of the heat pump of FIG. 4.
Figure 9:
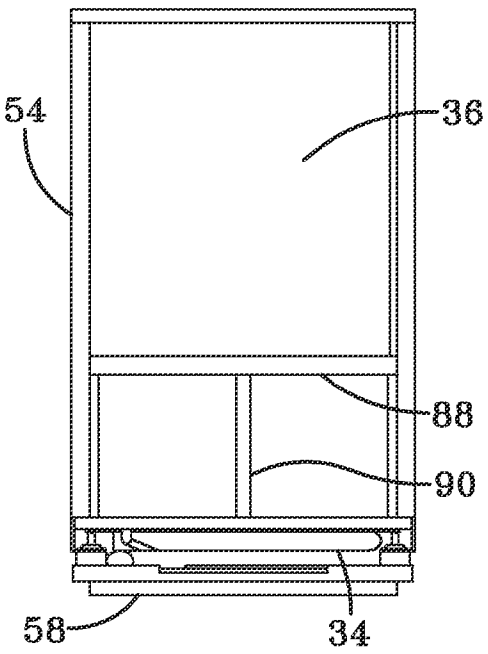
FIGS. 7-9 show respective rear, side and front views of an exemplary chassis.
Figure 8:
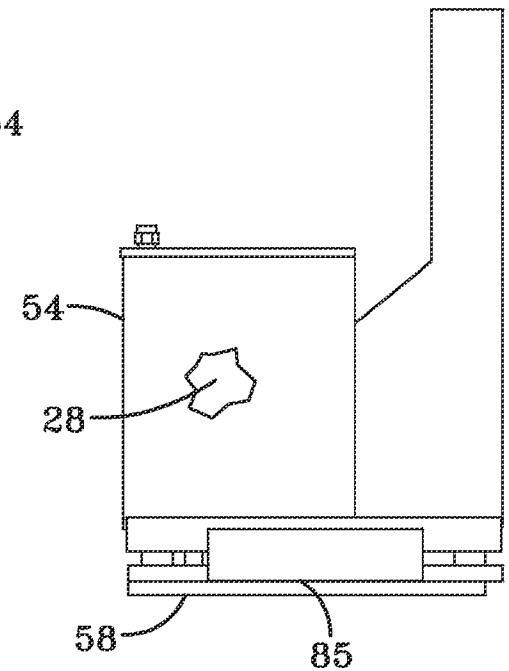
Figure 7:
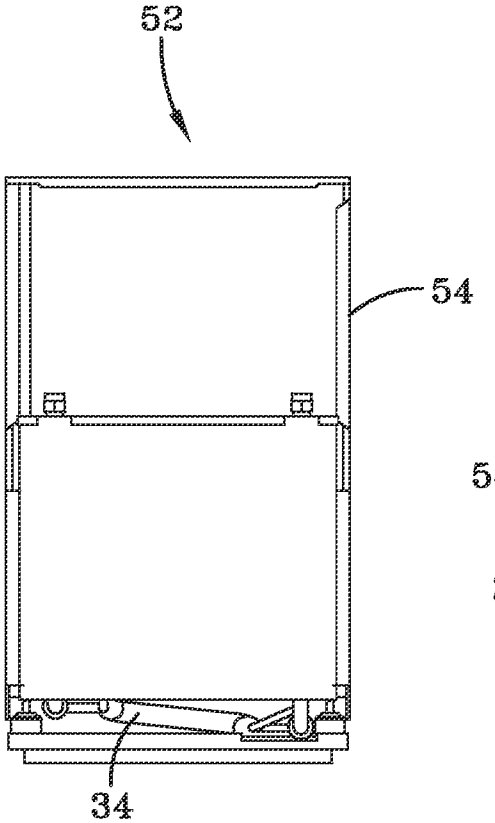

FIG. 4 shows an exemplary embodiment of an assembled heat pump 22. FIG. 5 shows an exemplary embodiment of the heat pump of FIG. 4 prior to insertion of an exemplary chassis 52 inside of enclosure 50 that includes an enclosure frame 56 for supporting chassis 52. Chassis 52 includes a chassis structure 54 securing at least compressor 28, heat exchanger 34 ((FIG. 6); that operates as an evaporator in heating mode 46 (FIG. 2) and as a condenser in cooling mode 48 (FIG. 3)), and heat exchanger 36 ((FIG. 6); which operates as a condenser in heating mode 46 (FIG. 2) and as an evaporator in cooling mode 48 (FIG. 3)). Compressor 28, heat exchanger 34 and heat exchanger 36 comprise primary components of the interconnected, self-contained refrigerant loop. Chassis 52 also includes a chassis structure 58 that supports chassis structure 54. As further shown in FIG. 5, enclosure 50 includes an opening 91, such as a flanged opening 92 extending outwardly from enclosure 50 for receiving return air 43 (FIG. 6) surrounding enclosure 50. Additionally shown in FIG. 5, enclosure 50 includes an opening 93, such as a flanged opening 94 extending outwardly from enclosure 50 for distributing supply air 45 (FIG. 6). It is to be understood that one or more openings of different sizes and shapes can be formed in the enclosure for distributing/receiving respective supply/return air for use in the system. As will be explained in further detail below, other than chassis structure 58 of chassis 52 being supported by enclosure frame 56 (FIG. 5), the remainder of chassis 52 components, including the self-contained refrigerant loop components, are positioned so as not to make physical contact, i.e., maintain a gap such as gap 26 (FIG. 6) relative to a corresponding wall of enclosure 50, resulting in improved noise attenuation during operation of heat pump 22 of the system.

As shown in FIGS. 7-10, chassis 52 includes chassis structure 54 that is configured to receive compressor 28, heat exchanger 34 and heat exchanger 36, primary components of the self-contained refrigerant loop. For example, a tray 88 positioned beneath heat exchanger 36 is in fluid communication with a tube 90 for conveying condensation accumulating in tray 88 through tube 90 for collection in another portion of enclosure 50, or to another area, as desired. As further shown in FIG. 10, chassis structure 54 includes opposed channels 60 having corresponding flanges 62 extending toward each other beneath compressor 28. As yet further shown in FIG. 10, openings 64 are formed in flanges 62 for receiving corresponding vibration damping devices 66 operatively connected to chassis structure 58.

Figure 10:
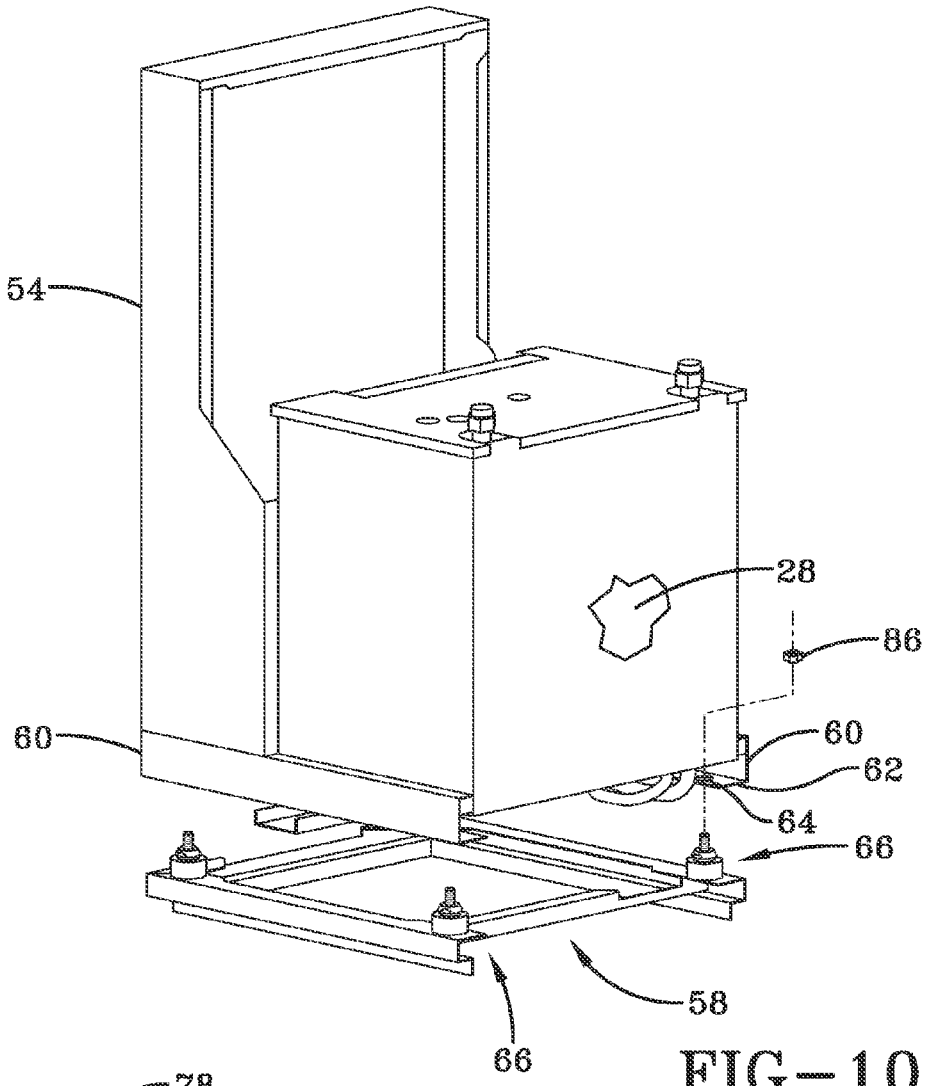
FIG. 10 shows a partially assembled chassis.
Figure 11:
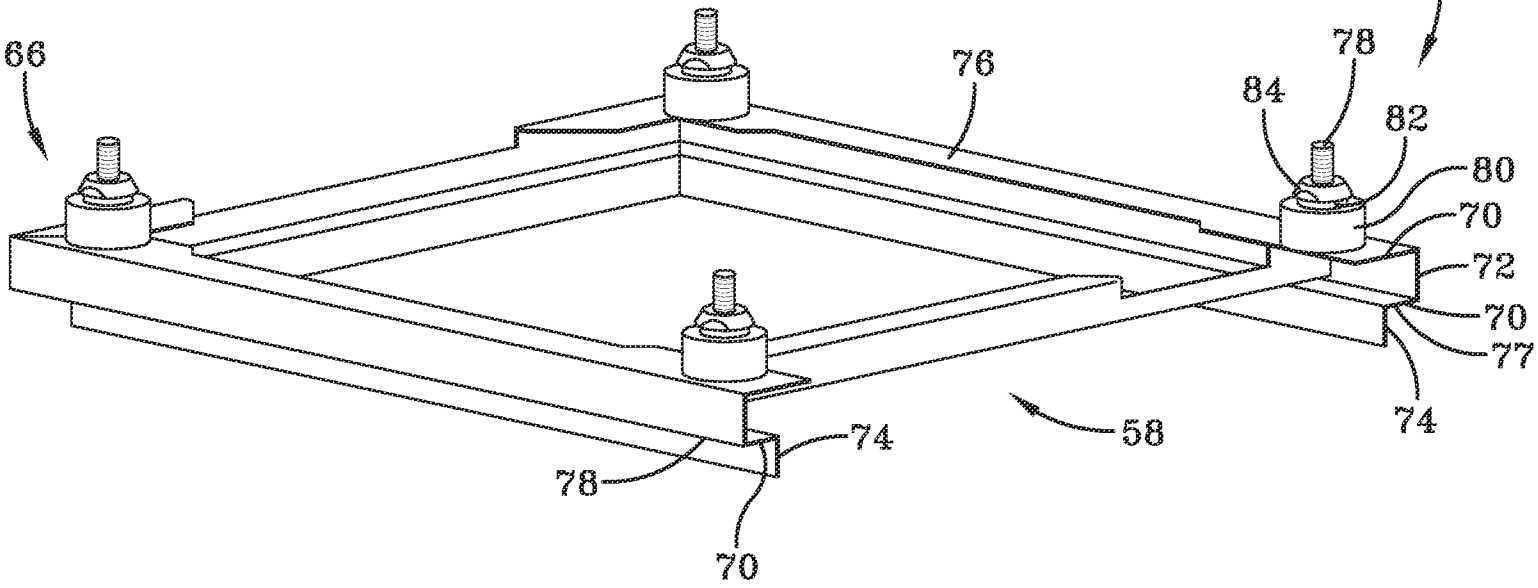
FIG. 11 shows a portion of an exemplary chassis.

As shown in FIGS. 10-11, chassis structure 58 structurally supports and vibrationally isolates chassis structure 54 of chassis 52. As further shown in FIG. 11, chassis structure 58 includes a plurality of structural frame segments 68, such as "C-channels" arranged in a closed geometric shape for enhanced rigidity and strength. Frame segments 68 include opposed legs 70 interconnected at one end of corresponding frame segments 68 by a web 72. From an opposite end of opposed frame segments 68 a flange 74 extends outwardly at an angle, such as a 90° angle relative to the frame segments 68. A surface 76 of leg 70 of frame segment 68 supports vibration damping device 66, while an opposed surface 77 of the other leg 70 facing away from surface 76 is configured to be supported by enclosure frame 56 of enclosure 50 (FIG. 5).

Figure 10A:
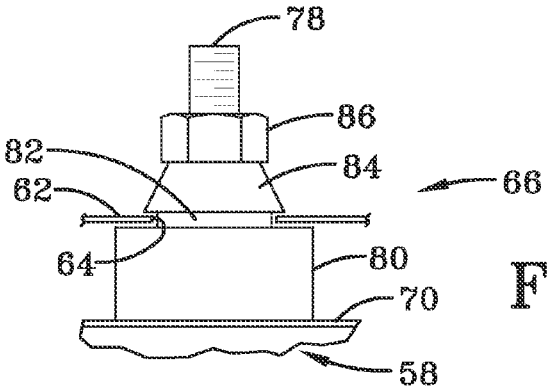
FIG. 10A shows an enlarged, partially assembled portion of the chassis of FIG. 10.

FIG. 11 shows vibration damping devices 66. As shown, each damping device 66 includes a threaded pin 78 having a head (not shown) that extends through chassis structure 58 and a resilient body 80 having a recessed portion 82 extending to a tapered portion 84. As further shown in FIGS. 10, 10A and 11, after aligning openings 64 formed in flanges 62 of channels 60 with corresponding pins 78 of vibration damping devices 66, protruding ends of pins 78 extending through body 80 are first inserted in openings 64, followed by tapered portions 84 and then by recessed portions 82, until flanges 62 of channels 60 are brought into vibrationally isolated contact with pins 78 by virtue of damping devices 66. Fasteners 86 (FIG. 10), such as nuts can then be threadedly engaged with corresponding pins 78 for securing chassis structure 58 to chassis structure 54 of chassis 52. As further shown in FIG. 8, and prior to installation of chassis 52 in a heat pump, an optional shipping brace 85 temporarily secured to each of chassis structures 54, 58 to prevent possible damage to vibration damping devices 66 during shipping is removed.

As shown in FIGS. 1-11, the operation of the system utilizing heat pump 22 is further discussed. Compressor 28, heat exchangers 36, 34 and expansion valve 44 of heat pump 22 operate together as part of a self-contained refrigerant loop, with heat exchangers 36, 34 operating as either a condenser/evaporator or an evaporator/condenser, depending upon whether heat pump 22 is operating in heating mode 46 or cooling mode 48. In each mode, heat exchanger 34 is in a heat exchange relationship with fluid from fluid source 30, subsequent to the fluid of fluid source 30 being heated and/or cooled by chiller 16 and boiler 40, if required, to provide the fluid (conditioned fluid) to heat pump 22 at a temperature greater than its dew point. However, in another embodiment, the fluid does not need to be greater than its dew point. During operation of fan 42, air surrounding enclosure 50 is drawn inside of enclosure 50 as return air 43 via opening 91, brought into heat exchange relationship with heat exchanger 36, and then discharged from enclosure 50 via opening 93 as supply air 45 to maintain temperature control of a desired portion of a building. The self-contained refrigerant loop components are secured to and supported by chassis 52 that is selectively insertable inside of enclosure 50 and vibrationally isolated from enclosure 50. Other than being secured to and supported by chassis 52, the self-contained refrigerant loop components are maintained in a non-contacting arrangement (i.e., a gap or spacing is maintained) relative to enclosure 50. As a result of this novel non-contacting arrangement of self-contained refrigerant loop components relative to the enclosure, the enclosure is vibrationally isolated from the refrigerant loop.

Figure 14:
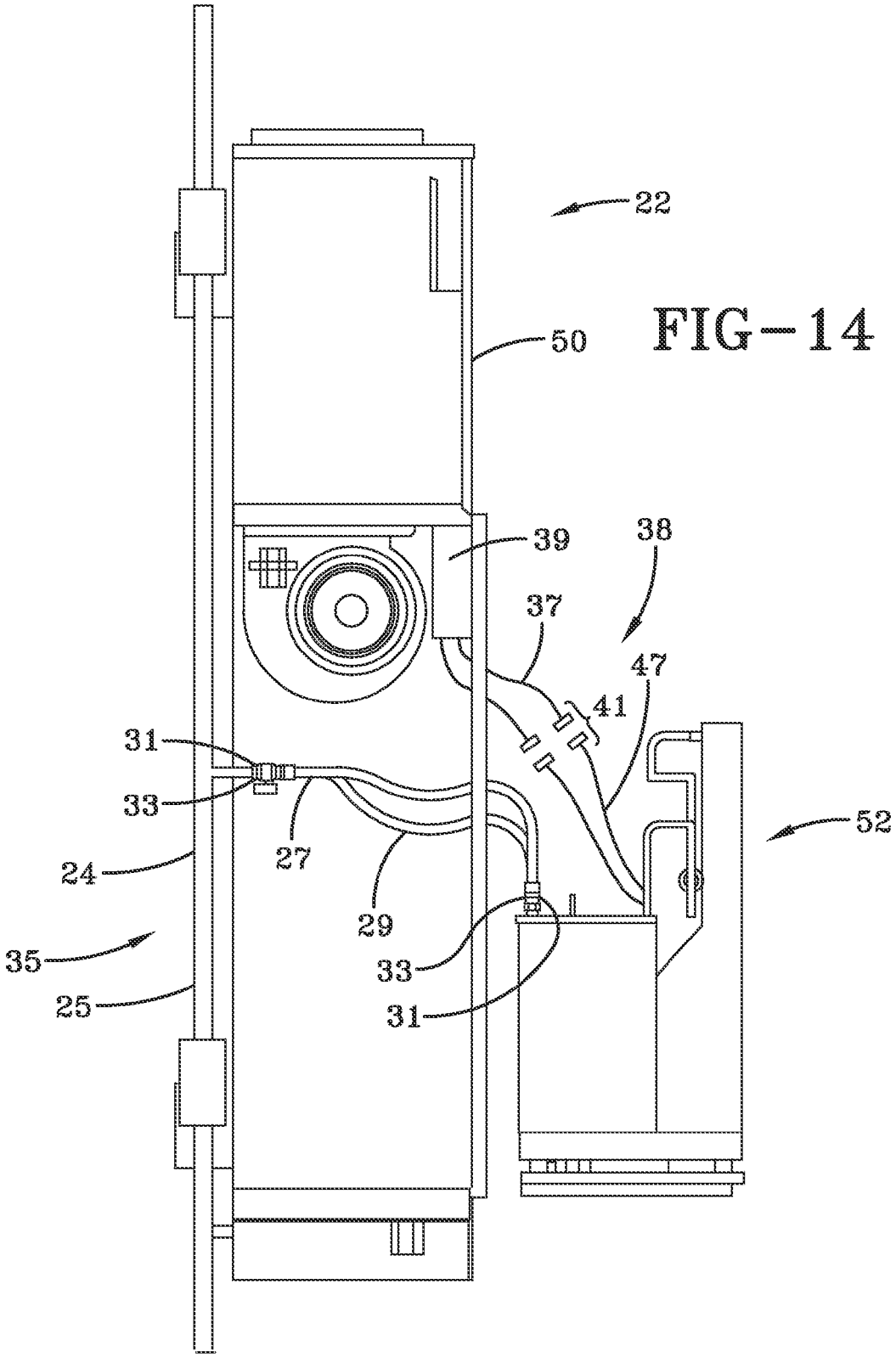
FIG. 14 shows a side view of the heat pump of FIG. 4 prior to insertion of an exemplary chassis, but after electrical/fluid connections have been made with components secured to the exemplary chassis.

Referring to FIG. 14, which shows chassis 52 prior to insertion inside of enclosure 50 and two sets of non-vibrationally sensitive connections with chassis 52. A first set of connections includes a pair of conduits 27, 29 having respective mating connectors 31, 33 for supplying and returning fluid via respective conduits 24, 25 to fluid source 30 (FIG. 2) as previously discussed. In FIG. 14, conduits 24, 27, 29 and mating connectors 31 are at least partially shown, but mating connectors 33 and conduit 25 are not shown in FIG. 14. As further shown in FIG. 14, a second set of connections includes a set of electrical conduits 37 extending from an electrical control compartment 39 of the heat pump 22 that are attached, via corresponding mating connectors 41, to a set of electrical conduits 47 extending from chassis 52. It is to be understood that a set of such connections may be combined into a single connection (i.e., single mating connectors), or in another embodiment may include more than two connections. In the case of set of connections 35, conduits 24, 25, 27, 29 are not intended to be in contact with enclosure 50 after chassis 52 is inserted inside of enclosure 50, with conduits 27, 29 typically being composed of a suitable flexible material. In one embodiment, conduits are prevented from contacting enclosure 50. Similarly, in the case of set of connections 38, conduits 37, 47 are typically composed of a suitable flexible material, and in one embodiment, conduits 37, 47 are maintained at a gap from enclosure 50, such as electrical control compartment 39 being separate (i.e., spaced apart from) enclosure 50.

For purposes herein, the term self-contained refrigerant loop is intended to include component secured to the chassis 52 interconnecting refrigerant lines interconnecting the components, comprising compressor 28 (FIG. 1) and heat exchangers 34, 36. However, it is to be understood that fluid connections, such as sets of connections 35 (FIG. 14) and electrical connections 38 (FIG. 14) are achieved via flexible lines that, as a practical matter, result in negligible or virtually zero noise generation.

Stated another way, for purposes herein, sets of connections, such as connections 35, 38 discussed above, which are not directly associated with circulating refrigerant as part of the refrigerant loop, and which otherwise would not cause or contribute to noise propagation to the enclosure, can be disregarded from consideration in the context of providing a contacting arrangement between the enclosure and the self-contained refrigerant loop.

Such vibration isolation provides noise attenuation to at least the heat pump of the system, that is typically generated by a panel (not shown) associated with return air, such as return air 43 (FIG. 3), and would cover flanged opening 92 (FIG. 5). In one embodiment, enclosure 50 can be constructed within the framework (e.g., the wall) of a building or room so as to otherwise be concealed, the return air panel being visible, but being of substantially flat construction and inconspicuous.

Temperature control of room sizes generally associated with hotels, e.g., 600-700 square feet, can be maintained by heat pumps incorporating vibration isolation features of the present disclosure. In other embodiments, room sizes can be larger or smaller than 600-700 square feet that one or more heat pumps can be utilized (separately or interconnected) for maintaining a predetermined temperature inside of a building space. In one embodiment, rotary compressors can be used. In another embodiment, a scroll compressor or other suitable compressor can be used. In another embodiment, a reciprocating compressor can be used. Irrespective the type of suitable compressor used, the heat pump of the present disclosure may be utilized for the reduction of noise associated with operation of the heat pump, so long as the velocity of the flow through each discharge opening of the enclosure is maintained between about 300 and about 500 feet per minute (ft./min.).

Figure 12:
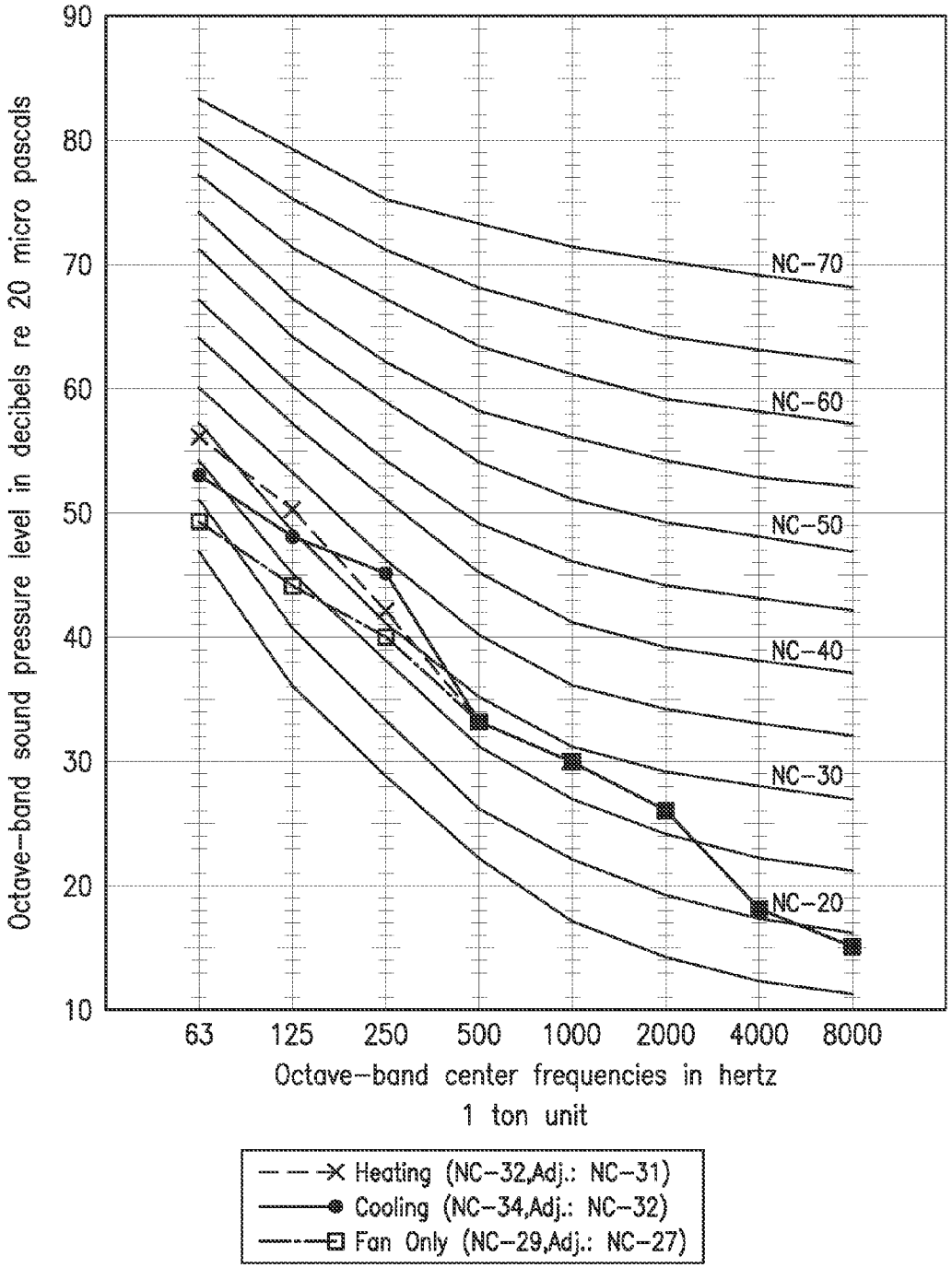
FIGS. 12 and 13 graphically shows noise criteria (NC) test results for different size units incorporating features of the present disclosure.
Figure 13:
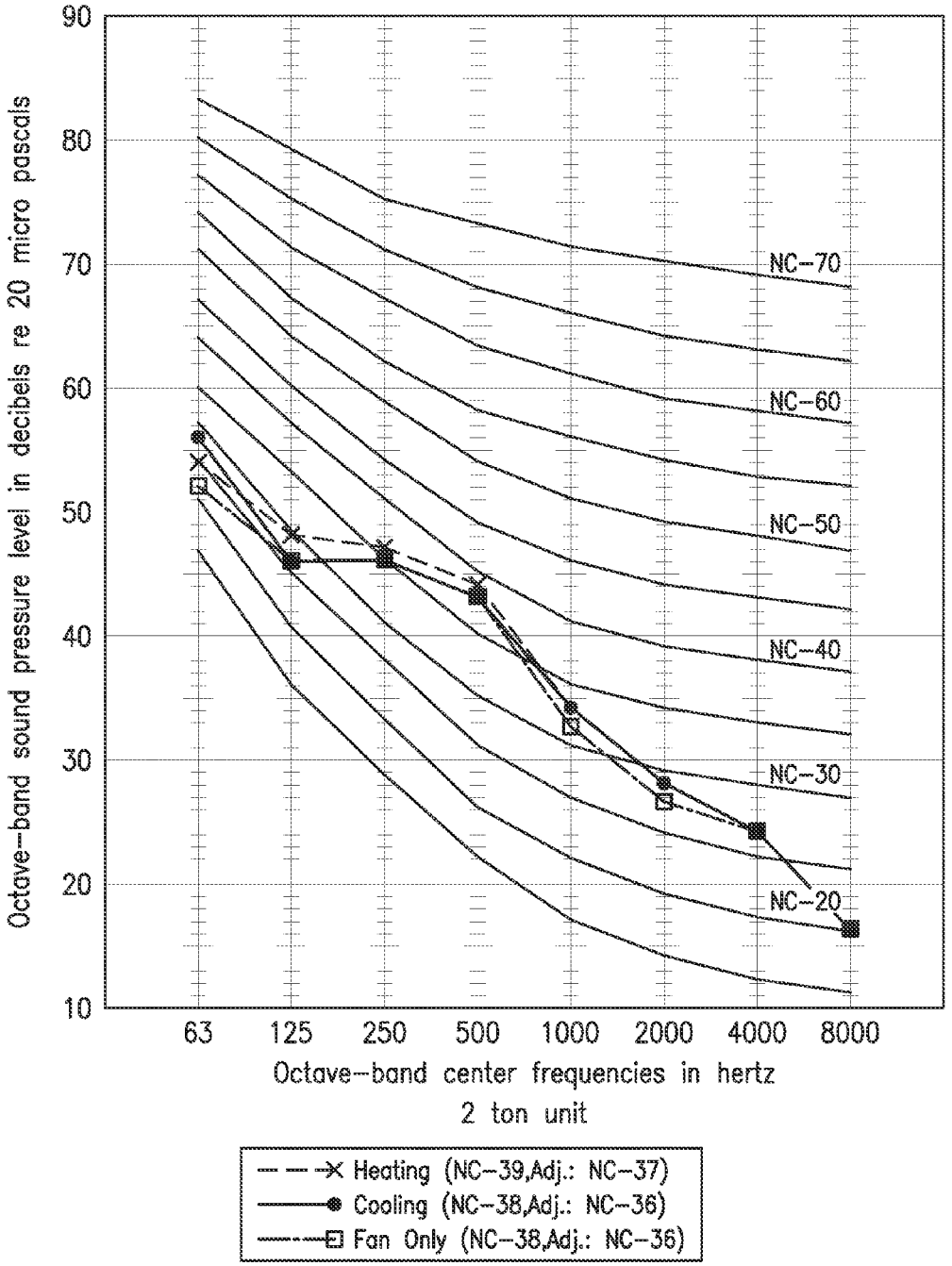

As shown in FIG. 12 (1 Ton unit) and FIG. 13 (2 Ton unit), noise criteria (NC) level testing has been conducted, comparing "reference" units in which the chassis has been modified to ensure there is clearance between the chassis and the enclosure of the units, as well as the addition of vibration isolators arranged in a manner similar as shown in FIG. 10 of the present disclosure. An NC level is a standard that describes the relative loudness of a space achieved by examining a range of frequencies (versus only recording the decibel level). The NC level illustrates the extent to which noise interferes with speech intelligibility, and where excessive noise would be irritating to the users. For each of the tested units, decibel measurements for band frequencies (in Hz) of 63, 125, 250, 500, 1,000, 2,000, 4,000 and 8,000 were plotted against specific NC levels for these frequencies. For the 1 Ton unit, the sound levels decreased by nearly one half. For the 2 Ton unit, while the amount of sound level reduction was less than that of the 1 Ton unit, the sound for the 2 Ton unit was dominated by fan noise.

While only certain features and embodiments of the invention have been shown and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

What is claimed is:

1. An apparatus for noise attenuation of an HVAC&R system, comprising:

an enclosure having a first enclosure frame;

a chassis insertable inside the enclosure and supported by the first enclosure frame upon insertion of the chassis inside the enclosure, the chassis comprising:

a first chassis structure comprising opposed channels at a base of the first chassis structure;

a self-contained refrigerant loop secured to the first chassis structure, the self-contained refrigerant loop maintaining a gap from the enclosure upon insertion of the chassis inside the enclosure, the self-contained refrigerant loop comprising a compressor, a first heat exchanger, and a second heat exchanger;

a second chassis structure supporting the first chassis structure, wherein the second chassis structure comprises a plurality of structural frame segments forming a plurality of C-channels; and at least one vibration damping device positioned partially within and partially beneath at least one channel of the opposed channels of the first chassis structure, such that the at least one vibration damping device extends through a circular aperture formed in a bottommost panel of the at least one channel of the opposed channels, wherein the at least one vibration damping device extends adjacent to a first surface of the at least one channel and extends adjacent to a second surface of the at least one channel, opposite the first surface, wherein the at least one vibration damping device is between the first chassis structure and the second chassis structure, wherein the at least one vibration damping device is a single-piece component, wherein the vibration damping device is directly supported by a third surface of a C-channel of the plurality of C-channels of the second chassis structure, wherein a fourth surface of the C-channel of the plurality of C-channels of the second chassis structure is directly supported by the first enclosure frame, wherein a web of the C-channel of the plurality of C-channels of the second chassis structure extends crosswise from a first terminal end of the fourth surface to the third surface in a first direction, wherein the second chassis structure comprises a flange extending crosswise from a second terminal end of the fourth surface of the C-channel of the plurality of C-channels in a second direction, opposite the first direction, wherein the first terminal end of the fourth surface is opposite the second terminal end of the fourth surface, and wherein the fourth surface extends from the web to the flange in a third direction, crosswise to the first direction, and wherein the enclosure is vibrationally isolated from the self-contained refrigerant loop.

2. The apparatus of claim 1, wherein the enclosure comprises an exhaust opening sized such that a noise level associated with providing air discharged from the exhaust opening for climate control of a structure relative to a noise level associated with operation of the compressor is not greater than a predetermined ratio.

3. The apparatus of claim 1, wherein the compressor is a positive displacement type compressor.

4. The apparatus of claim 1, wherein the compressor is a scroll compressor.

5. The apparatus of claim 1, wherein the compressor is a reciprocating compressor.

6. The apparatus of claim 1, wherein the compressor is a rotary compressor.

7. The apparatus of claim 2, wherein each exhaust opening formed in the enclosure is sized to permit an air velocity of up to about 400 feet per minute.

8. The apparatus of claim 2, wherein each exhaust opening formed in the enclosure is sized to permit an air velocity of between about 300 feet per minute and about 500 feet per minute.

9. The apparatus of claim 1, wherein the first chassis structure and the second chassis structure are secured together by a brace that is removed prior to insertion of the chassis inside the enclosure.

10. The apparatus of claim 1, wherein the self-contained refrigerant loop operates as a heat pump.

11. A method for noise attenuation of an HVAC&R system having a compressor including a closed refrigerant loop comprising a first heat exchanger and a second heat exchanger for selectively providing climate control for a structure, the method comprising:

providing a chassis for securing at least each of the compressor, the first heat exchanger and the second heat exchanger of the closed refrigerant loop in an enclosure, the closed refrigerant loop being self-contained and maintained in non-contact with the enclosure when the chassis is positioned in the enclosure, wherein the chassis comprises a first chassis structure having opposed channels at a base of the first chassis structure and a second chassis structure having a plurality of structural frame segments forming a plurality of C-channels, wherein at least one vibration damping device is positioned partially within and partially beneath at least one channel of the opposed channels of the first chassis structure, such that the at least one vibration damping device extends through a circular aperture formed in a bottommost panel of the at least one channel of the opposed channels, wherein the at least one vibration damping device extends adjacent to a first surface of the at least one channel and extends adjacent to a second surface of the at least one channel, opposite the first surface, and wherein the at least one vibration damping device is between the first chassis structure and the second chassis structure, wherein the at least one vibration damping device is a single-piece component, wherein the at least one vibration damping device is directly supported by a third surface of a C-channel of the plurality of C-channels of the second chassis structure, wherein a fourth surface of the C-channel of the plurality of C-channels of the second chassis structure is directly supported by the first enclosure frame, wherein a web of the C-channel of the plurality of C-channels of the second chassis structure extends crosswise from a first terminal end of the fourth surface to the third surface in a first direction, wherein the second chassis structure comprises a flange extending crosswise from a second terminal end of the fourth surface of the C-channel of the plurality of C-channels in a second direction, opposite the first direction, wherein the first terminal end of the fourth surface is opposite the second terminal end of the fourth surface, and wherein the fourth surface extends from the web to the flange in a third direction, crosswise to the first direction; and operating the system.

12. An HVAC&R system comprising:

an enclosure having a first enclosure frame;

a chassis insertable inside the enclosure and supported by the first enclosure frame upon insertion of the chassis inside the enclosure, the chassis comprising:

a first chassis structure comprising opposed channels at a base of the first chassis structure;

a self-contained refrigerant loop secured to the first chassis structure, the self-contained refrigerant loop maintaining a gap from the enclosure upon insertion of the chassis inside the enclosure, the self-contained refrigerant loop comprising a compressor, a first heat exchanger, and a second heat exchanger;

a second chassis structure supporting the first chassis structure, wherein the second chassis structure comprises a plurality of structural frame segments forming a plurality of C-channels; and at least one vibration damping device positioned partially within and partially beneath at least one channel of the opposed channels of the first chassis structure, such that the at least one vibration damping device extends through a circular aperture formed in a bottommost panel of the at least one channel of the opposed channels, wherein the at least one vibration damping device extends adjacent to a first surface of the at least one channel and extends adjacent to a second surface of the at least one channel, opposite the first surface, wherein the at least one vibration damping device is between the first chassis structure and the second chassis structure, wherein the at least one vibration damping device is a single-piece component, wherein the vibration damping device is supported by a third surface of a C-channel of the plurality of C-channels of the second chassis structure, wherein a fourth surface of the C-channel of the plurality of C-channels of the second chassis structure is directly supported by the first enclosure frame, wherein a web of the C-channel of the plurality of C-channels of the second chassis structure extends crosswise from a first terminal end of the fourth surface to the third surface in a first direction, wherein the second chassis structure comprises a flange extending crosswise from a second terminal end of the fourth surface of the C-channel of the plurality of C-channels in a second direction, opposite the first direction, wherein the first terminal end of the fourth surface is opposite the second terminal end of the fourth surface, and wherein the fourth surface extends from the web to the flange in a third direction, crosswise to the first direction, and wherein the enclosure is vibrationally isolated from the self-contained refrigerant loop.

* * * * *